US008146765B2

(12) United States Patent
Chen

(10) Patent No.: US 8,146,765 B2
(45) Date of Patent: Apr. 3, 2012

(54) SEALING COVER FOR CONTAINERS

(75) Inventor: Hsin-Yu Chen, Taichung (TW)

(73) Assignee: Idearite Co., Ltd., Zhubei, Hsinchu County (TW)

( * ) Notice: Subject to any disclaimer, the term of this patent is extended or adjusted under 35 U.S.C. 154(b) by 0 days.

(21) Appl. No.: 12/160,394

(22) PCT Filed: Jun. 20, 2007

(86) PCT No.: PCT/CN2007/001937

§ 371 (c)(1),
(2), (4) Date: Jul. 9, 2008

(87) PCT Pub. No.: WO2008/154774

PCT Pub. Date: Dec. 24, 2008

(65) Prior Publication Data

US 2010/0270304 A1 Oct. 28, 2010

(51) Int. Cl.

| | |
|---|---|
| ***B65D 51/16*** | (2006.01) |
| ***B65D 43/04*** | (2006.01) |
| ***B65D 53/00*** | (2006.01) |
| *B65D 41/56* | (2006.01) |

(52) U.S. Cl. ..... 220/231; 220/378; 220/804; 220/212; 215/262

(58) Field of Classification Search ..... 220/805, 220/791, 231, 804, 803, 367.1, 203, 19, 203.29, 220/657, 798, 801, 212, 378; 277/390, 395, 277/530, 567, 647, 944; 251/319, 320, 298; 137/521, 522; 215/262

See application file for complete search history.

(56) References Cited

U.S. PATENT DOCUMENTS

| | | | | |
|---|---|---|---|---|
| 4,249,583 | A * | 2/1981 | Lundbladh | 141/65 |
| 5,449,079 | A * | 9/1995 | Yang | 215/228 |
| 5,944,211 | A * | 8/1999 | Woodnorth et al. | 220/203.13 |
| 7,048,136 | B2 * | 5/2006 | Havens et al. | 220/212 |
| 7,357,273 | B1 * | 4/2008 | Lutz et al. | 220/785 |
| 7,614,522 | B2 * | 11/2009 | Hsu | 220/367.1 |

* cited by examiner

*Primary Examiner* — Robin Hylton
(74) *Attorney, Agent, or Firm* — Muncy, Geissler, Olds & Lowe, PLLC

(57) ABSTRACT

A sealing cover includes a cover coupling with a seal ring which has two blades to form a double sealing effect. Thus a container can be sealed by the cover more securely and the opening of the container can be maintained intact. The cover also has a coupling opening and a plurality of air vents. The coupling opening is coupled with an air permeable parasol valve which can release air to facilitate capping of the cover on the opening of the container. Through an air suction means the container can be vacuumed.

5 Claims, 8 Drawing Sheets

SEALING COVER FOR CONTAINERS

CROSS REFERENCE TO RELATED APPLICATIONS

This is a National Phase Application in the United States of International Patent Application No. PCT/CN2007/001937 filed on Jun. 20, 2007 in China. The entire disclosures of the above patent applications are hereby incorporated by reference.

FIELD OF THE INVENTION

The present invention relates to a sealing cover and particularly to a sealing cover that is simply structured and adaptable to be used on containers formed in various shapes and made from different materials and is vacuum-enabled.

BACKGROUND OF THE INVENTION

A conventional sealing cover adopted for use on containers of varying openings, such as an example of a container 10 shown in FIG. 1 that has a round opening, mainly includes a cover 20 to cap a top rim 11 at the opening of the container 10. The cover 20 has an annular groove 23 at a location in contact with the top rim 11. A sealing pad 24 is provided in the groove 23. When the top rim 11 is wedged in the groove 23 it forms a close contact with the sealing pad 24.

The container 10 also has a plurality of jutting anchor portions 12 on an outer side close to the top rim 11. The cover 20 has the perimeter coupled with latch ledges 21 which can be rotated relative to the cover 20. Each of the latch ledges 21 has at least one aperture 22 corresponding to one anchor portion 12. When the cover 20 is mounted onto the opening of the container 10, the latch ledge 21 may be depressed towards the anchor portion 12 to allow the aperture 22 to be passed through by the anchor portion 12 to form a latched condition. Thus the cover 20 can tightly cap the opening of the container 10. By tightly compressing the sealing pad 24 in the groove 23 through the top rim 11 the internal space of the container 10 is isolated from the exterior to form a sealed condition.

However, after repetitive latching and rotating when in use for a period of time, the latch ledges 21 are prone to break or fracture at the joined locations. While increasing the thickness at the joined locations can reduce the risk of breaking or fracturing, to latch and disengage the latch ledges 21 when in use require a greater effort. It also is not operable single-handed. Moreover, the design of the anchor portions 12 makes the opening of the container 10 difficult to maintain a desired integrity. For instance, when the opening is circular, the apertures 22 of the latch ledges 21 have to be aligned accurately with the anchor portions 12 to form a tight coupling. It is not convenient in practice.

To solve the aforesaid problem, another type of cover 40 has been developed as shown in FIG. 2. A container 30 with a round opening also is used as an example to mate the cover 40. The container 30 has a smooth top rim 31 at the opening location. The cover 40 is located above the top rim 31. The cover 40 has an annular jutting portion 43 at a lower side and a lower surface around the annular jutting portion 43 to form a top coupling portion 41. The top coupling portion 41 has one spot extended outwards to form a moving flange 42. The annular jutting portion 43 has an outer diameter slightly smaller than the inner diameter of the opening of the container 30 and an annular groove 44 surrounding an outer wall thereof. A blade type sealing ring 45 is provided to be wedged in the groove 44 with a portion exposed outside. The sealing ring 45 has an air vent 46 in the center on a selected location.

When the cover 40 is caped on the top rim 31 of the container 30, the annular jutting portion 43 is squeezed in an inner side of the opening of the container 30. The air in the container 30 is discharged through the air vent 46 to allow the annular jutting portion 43 and the sealing ring 45 to be inserted by squeezing and compression until the top coupling portion 41 is in contact with the top rim 31. And the exposed sealing ring 45 is squeezed between the annular jutting portion 43 and the inner wall of the container 30 to isolate the internal space of the container 30 from the exterior to form a sealed condition. Through the moving flange 42 the cover 40 can be easily moved upwards and separated from the opening of the container 30.

While the blade type sealing ring 45 allows the opening of the container 30 to maintain the original shape, the air vent 46 for air discharging damages the sealing effect. Moreover, the sealing covers previously discussed provide only sealing function, but do not provide vacuuming function for the interior of the container.

SUMMARY OF THE INVENTION

The primary object of the present invention is to provide a sealing cover to be used on a container without the need of providing jutting anchor portions thereon. Sealing elements also do not need air vents. It can form a sealed condition for containers with any shape of opening. The sealing effect is more secured. The shape of the container opening also can be maintained intact. When in use there is no alignment problem, thus is more convenient.

Another object of the invention is to provide a sealing cover that also can provide vacuuming function. Through a vacuum means the air in the container can be drawn out to form a vacuum condition in the interior. The invention also provides a double seal ring design to make sealing effect more secured to maintain the vacuum condition in the container. Therefore goods held in the container have a longer preservation period.

The invention provides a cover to seal a container. It has the following features: an annular jutting portion is provided at a lower side of the cover to be inserted in an opening of the container with a top coupling portion formed on the periphery thereof; an annular seal ring is provided to surround the annular jutting portion that has two blades extended outwards to form a first seal ring fastened to the surface of the top coupling portion and a second seal ring close to the top end of the annular jutting portion; a coupling opening is formed on the surface of the cover which has at least one air vent around the coupling opening; and an air permeable parasol valve is provided and installed on the coupling opening.

In one aspect the annular jutting portion has an outer diameter slightly smaller than the opening of the container so that after the annular jutting portion is inserted in the opening the second seal ring is squeezed between the annular jutting portion and an inner wall of the container to isolate the internal space of the container from the exterior to form a sealed condition, and the first seal ring is squeezed between the top coupling portion and the top rim of the opening of the container.

In another aspect the top coupling portion further has an annular groove surrounding the jutting annular portion to be wedged in by the first seal ring so that the top coupling portion and the surface of the first seal ring form a flat surface.

In yet another aspect the air permeable parasol valve includes a flange blade covering the upper side of the air vent, a depressing portion located above the flange blade and a retaining portion located below the flange blade to be coupled with the coupling opening to fasten the air permeable parasol valve.

In yet another aspect the air permeable parasol valve provides air discharge function to facilitate capping of the cover on the container opening. And an air suction means can be disposed to draw the air in the container through the air permeable parasol valve to vacuum the interior of the container. Through the first seal ring a secured sealing effect can be achieved without the concern of deformation that might occur to the second seal ring. And the vacuum condition in the container can be maintained securely by the cover.

In yet another aspect the top coupling portion has a moving flange extended from a selected location to facilitate upward removing of the cover to separate the cover from the container opening.

In yet another aspect the depressing portion and the flange blade are joined at a juncture which has an indented bending trough formed thereon to facilitate warping up of the flange blade to be moved away from the air vent.

In yet another aspect the cover has an indented recess on the top surface with the coupling opening formed thereon to facilitate installation of the air suction means to perform air drawing operation.

By means of the construction set forth above, the invention provides at least the following advantages: through the double sealing structure of two blade types seal rings the exterior of the container does not have to provide jutting means for anchoring, and there is no restriction on the shape of the container opening; no alignment for coupling is needed when in use; and operation is easier. Through the air permeable parasol valve which can release air, no air vent is required on the seal rings. Thus an improved sealing effect can be achieved. Through the air permeable parasol valve the air in the container can be drawn out through an air suction means to form a vacuum condition in the container.

In addition, as the second seal ring squeezed between the annular jutting portion and the inner wall of the container might be deformed after vacuuming and result in air leakage, the first seal ring can provide a more secured sealing effect due to a tighter compression between the cover and the container after vacuuming. Hence any gap that might occur between the annular jutting portion and the inner wall of the container and due to thickness accuracy of the second seal ring does not make significant impact to the overall sealing effect. Hence the problem of air leakage resulting from the second seal ring after vacuuming can be overcome. Fabrication also is simpler.

The foregoing, as well as additional objects, features and advantages of the invention will be more readily apparent from the following detailed description, which proceeds with reference to the accompanying drawings. The embodiments discussed below are merely for illustrative purpose, and shall not be deemed as the limitation of the invention.

DETAILED DESCRIPTION OF THE PREFERRED EMBODIMENTS

Figure 1:
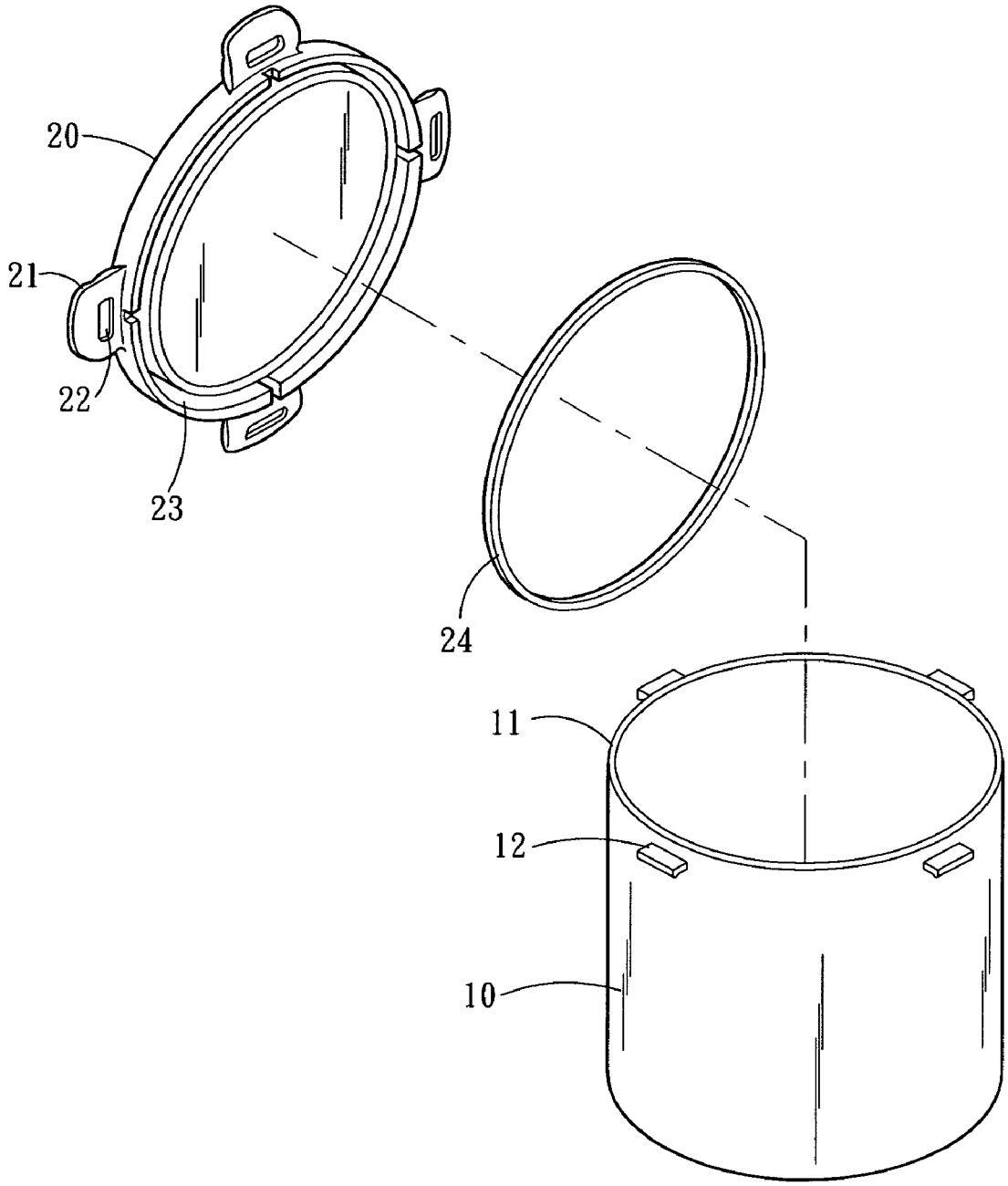
Fig. 1 PRIOR ART
FIG. 1 is an exploded view of a conventional sealing cover and a container.
Figure 2:
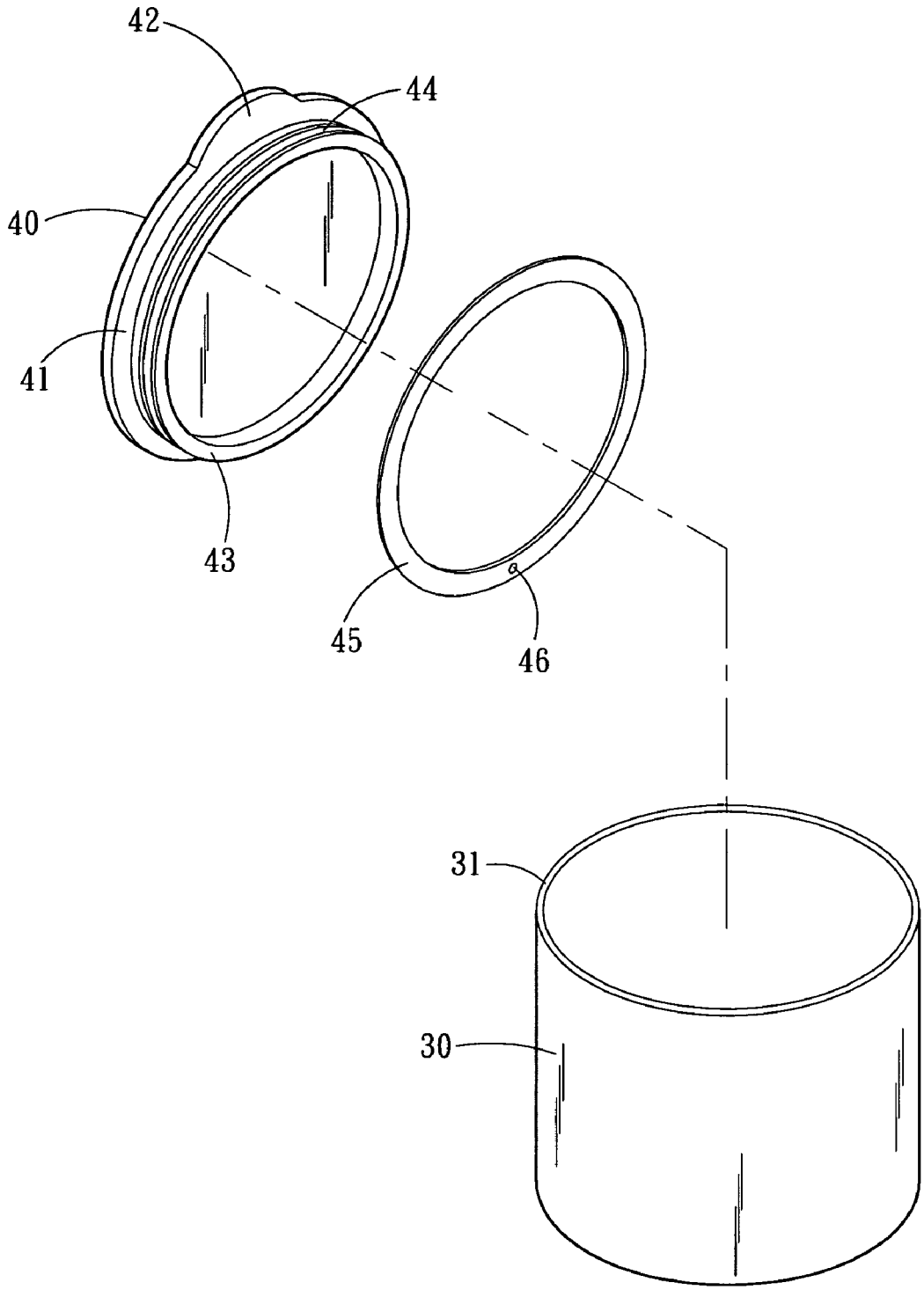
Fig. 2 PRIOR ART
FIG. 2 is an exploded view of another conventional sealing cover and a container.
Figure 3:
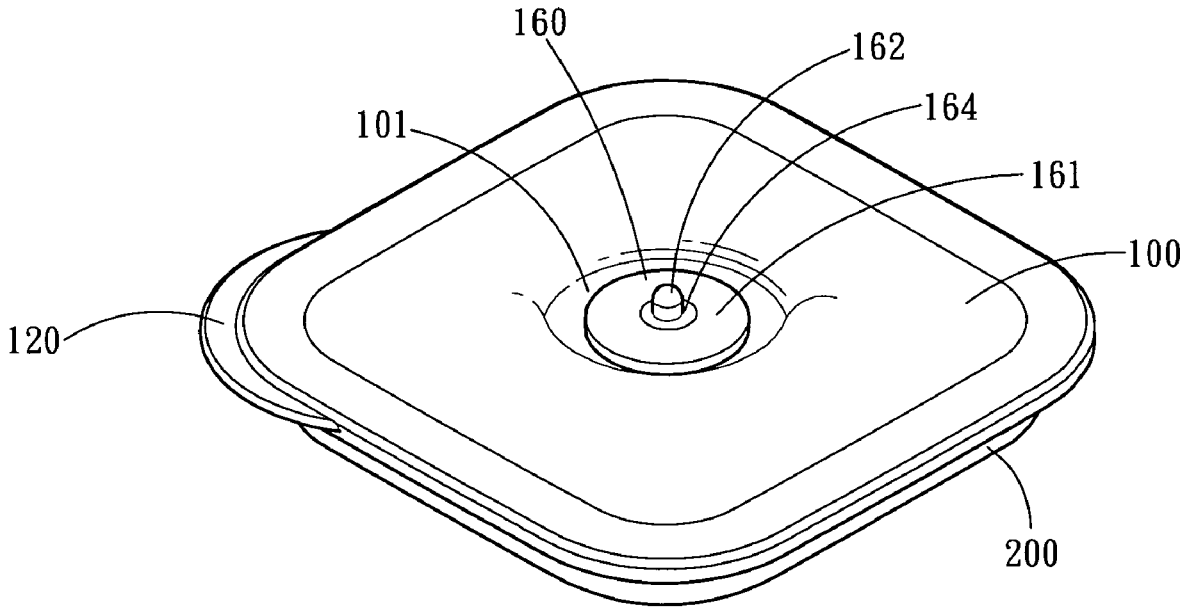
FIG. 3 is a perspective view of the sealing cover of the invention.
Figure 4:
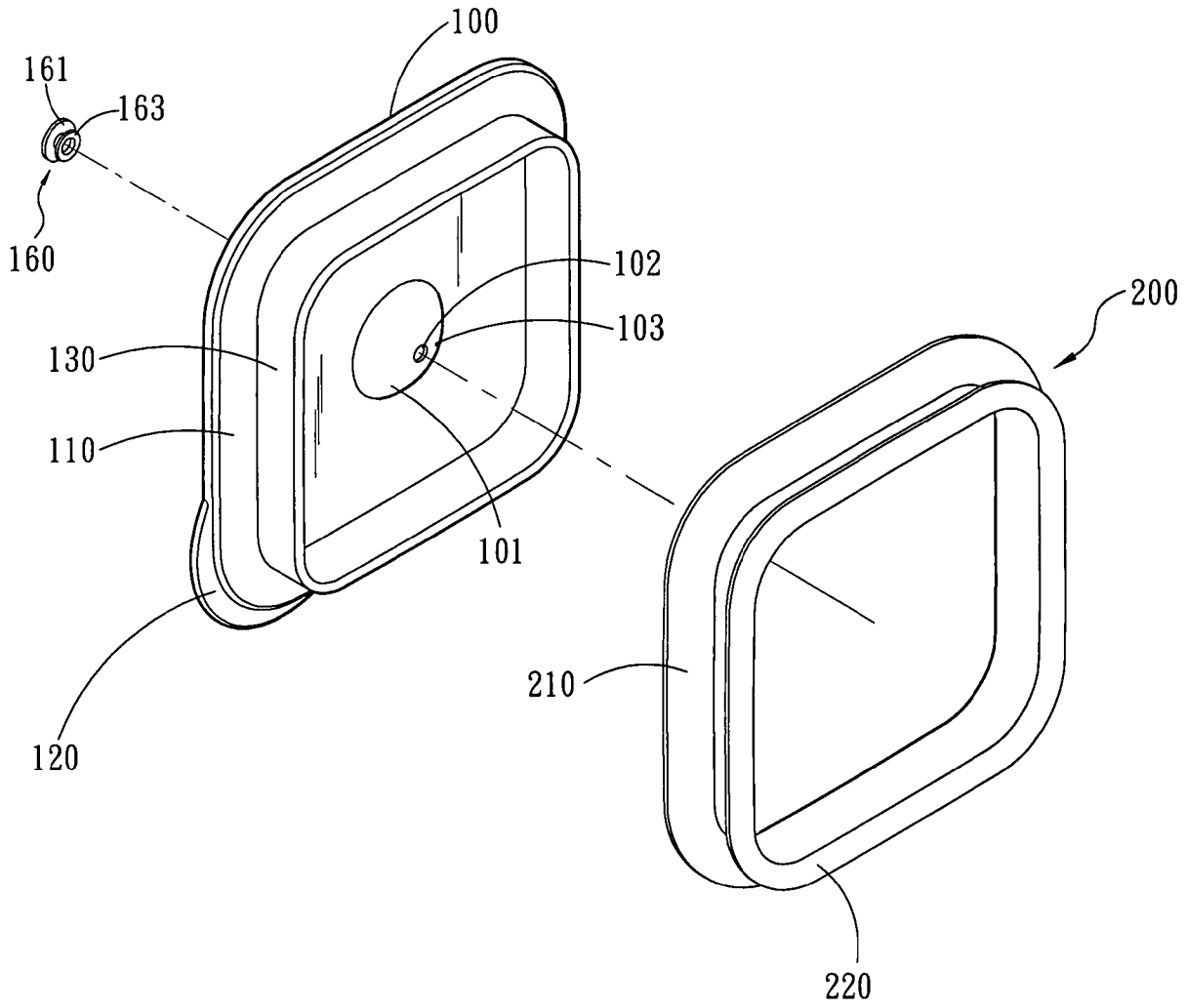
FIG. 4 is an exploded view of the sealing cover of the invention.
Figure 7:
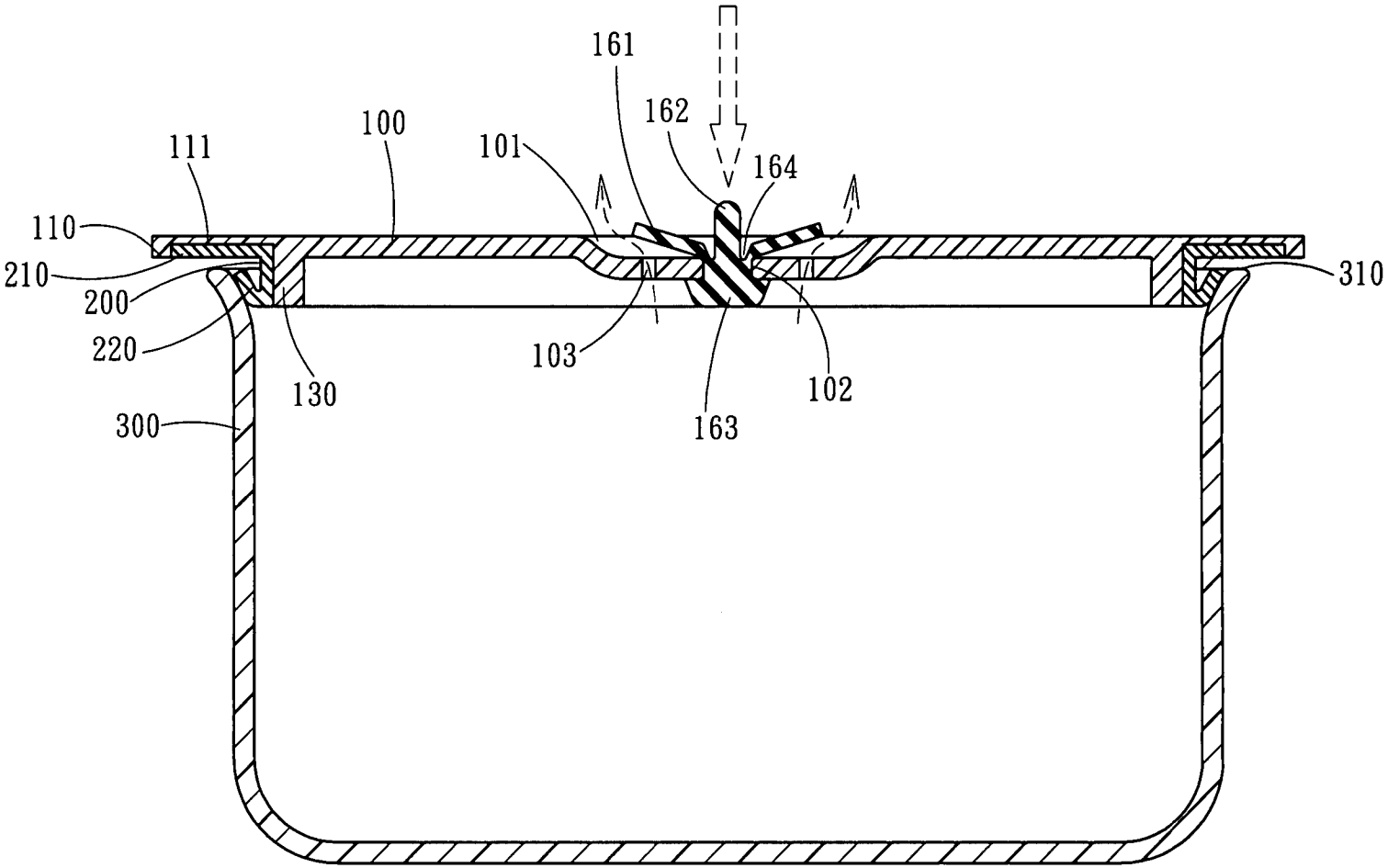
FIG. 7 is a sectional view of the sealing cover of the invention coupling with a container in a use condition.

Please refer to FIGS. 3, 4 and 7, the sealing cover according to the invention aims to be used on a cover 100 to seal a container 300. The cover 100 includes features as follow: an annular jutting portion 130 located at a lower side thereof to be coupled with an opening of the container 300. The annular jutting portion 130 has a top coupling portion 110 on the periphery that further is extended to form a moving flange 120 at a selected location to facilitate moving upward of the cover 100 to be separated from the opening of the container 300.

Figure 5:
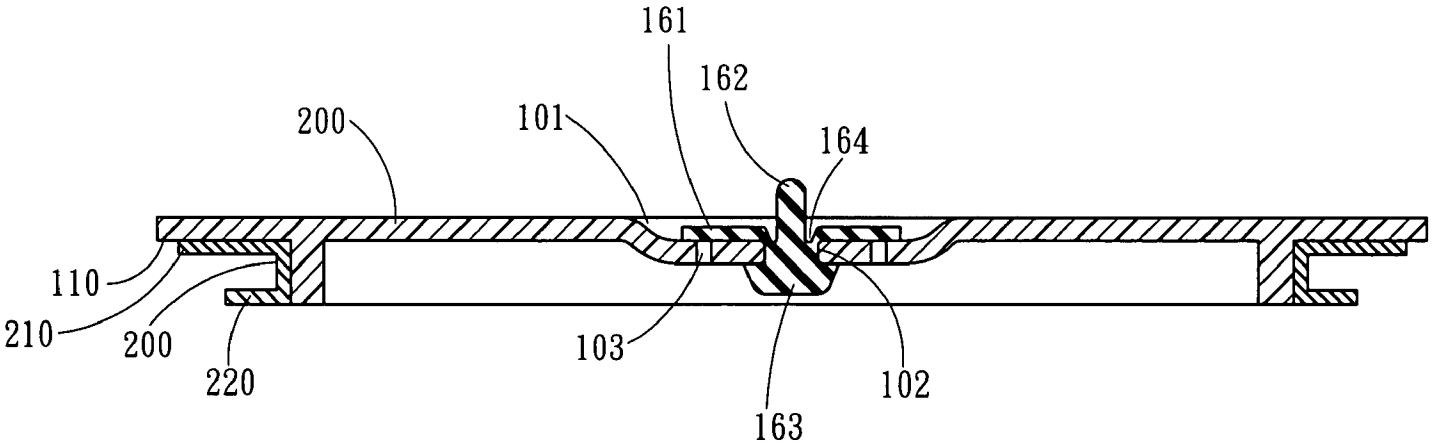
FIG. 5 is a sectional view of the sealing cover of the invention.
Figure 6:
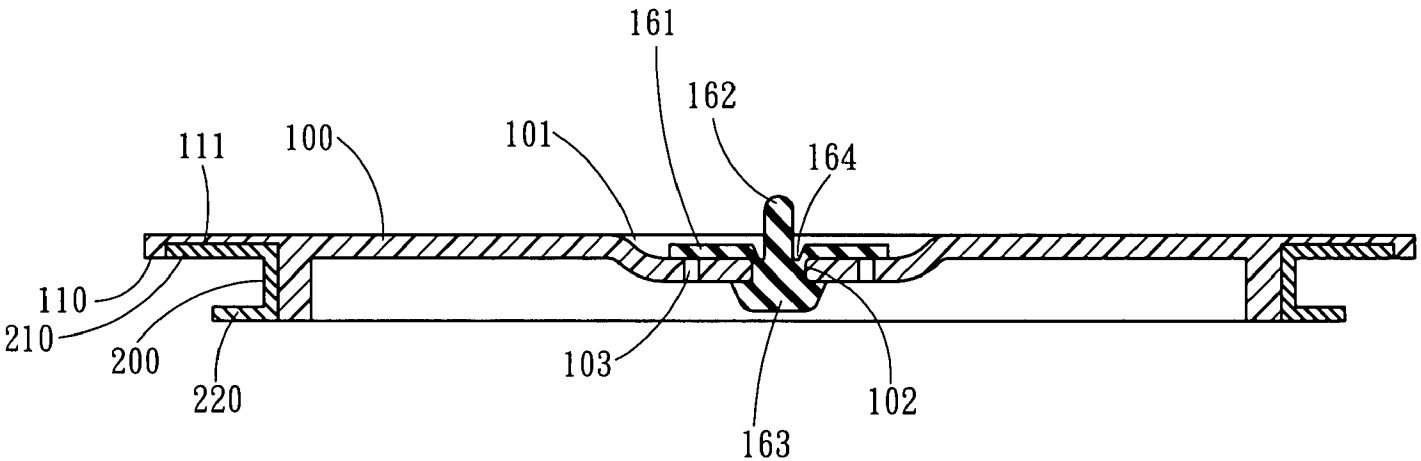
FIG. 6 is a sectional view of another embodiment of the sealing cover of the invention.

The annular jutting portion 130 is surrounded by a seal ring 200 at an outer side. The seal ring 200 has two blade type rings extended outwards including a first seal ring 210 and a second seal ring 220. The first seal ring 210 is fastened to the surface of the top coupling portion 110 and the second seal ring 220 is close to a top end of the annular jutting portion 130 (also referring to FIG. 5). In practice the top coupling portion 110 further has a groove 111 surrounding the annular jutting portion 130 to be wedged in by the first seal ring 210 so that the top coupling portion 110 and the surface of the first seal ring 210 form a flat surface (referring to FIG. 6).

The jutting annular portion 130 has an outer diameter slightly smaller than the inner diameter of opening of the container 300 so that after the annular jutting portion 130 is inserted in the opening of the container 300 the second seal ring 220 is squeezed between the annular jutting portion 130 and an inner wall of the container 300. The first seal ring 210 also is squeezed between the top coupling portion 110 and a top rim 310 at the opening of the container 300 so that the internal space of the container 300 is isolated from the exterior to form a sealed condition.

The cover 100 has a coupling opening 102 on the surface and at least one air vent 103 around the coupling opening 102, and an air permeable parasol valve 160 coupled on the coupling opening 102 to control air intake and discharge between the container 300 and the exterior. The air permeable parasol valve 160 includes a flange blade 161 formed at a width to cover an upper side of the air vent 103 to be in contact closely with the surface of the cover 100, a depressing portion 162 above the flange blade 161 and a retaining portion 163 below the flange blade 161 to be inserted into the coupling opening 102. For assembly the air permeable parasol valve 160 is forcefully inserted in the coupling opening 102 through the retaining portion 163 which is latched on a lower side of the cover 100 to form anchoring. Moreover, the depressing portion 162 and the flange blade 161 are joined at a juncture which has an indented bending trough 164 to allow the flange blade 161 to be easily bent and warped upwards through the depressing portion 162 so that the flange blade 161 can be separated from the air vent 103 at the upper side to allow the interior of the container 300 to communicate with the exterior.

Referring to FIG. 7, to cap the cover 100 on the opening of the container 300, insert initially a portion of the annular jutting portion 130 in the opening of the container 300, the second seal ring 220 is squeezed between the annular jutting portion 130 and the inner wall of the container 300. At this moment the pressures inside and outside the container 300 are unbalanced, hence it is difficult to cap the cover 100 and the annular jutting portion 130 cannot be fully inserted in the opening of the container 300. Through the air release function of the air permeable parasol valve 160, the depressing portion 162 can be depressed to warp the flange blade 161 upwards, and the pressures inside and outside the container 300 can be balanced through the air vent 103 of the cover 100. Then the annular jutting portion 130 and the second seal ring 220 can be inserted continuously through the opening of the container 300 until the first seal ring 210 at the top coupling portion 110 presses the top rim 310 of the opening of the container 300. When the depressing portion 162 is released the cover 100 isolates the internal space of the container 300 from the exterior to form a sealed condition through the first seal ring 210 and the second seal ring 220 that are made from elastic material.

Figure 8:
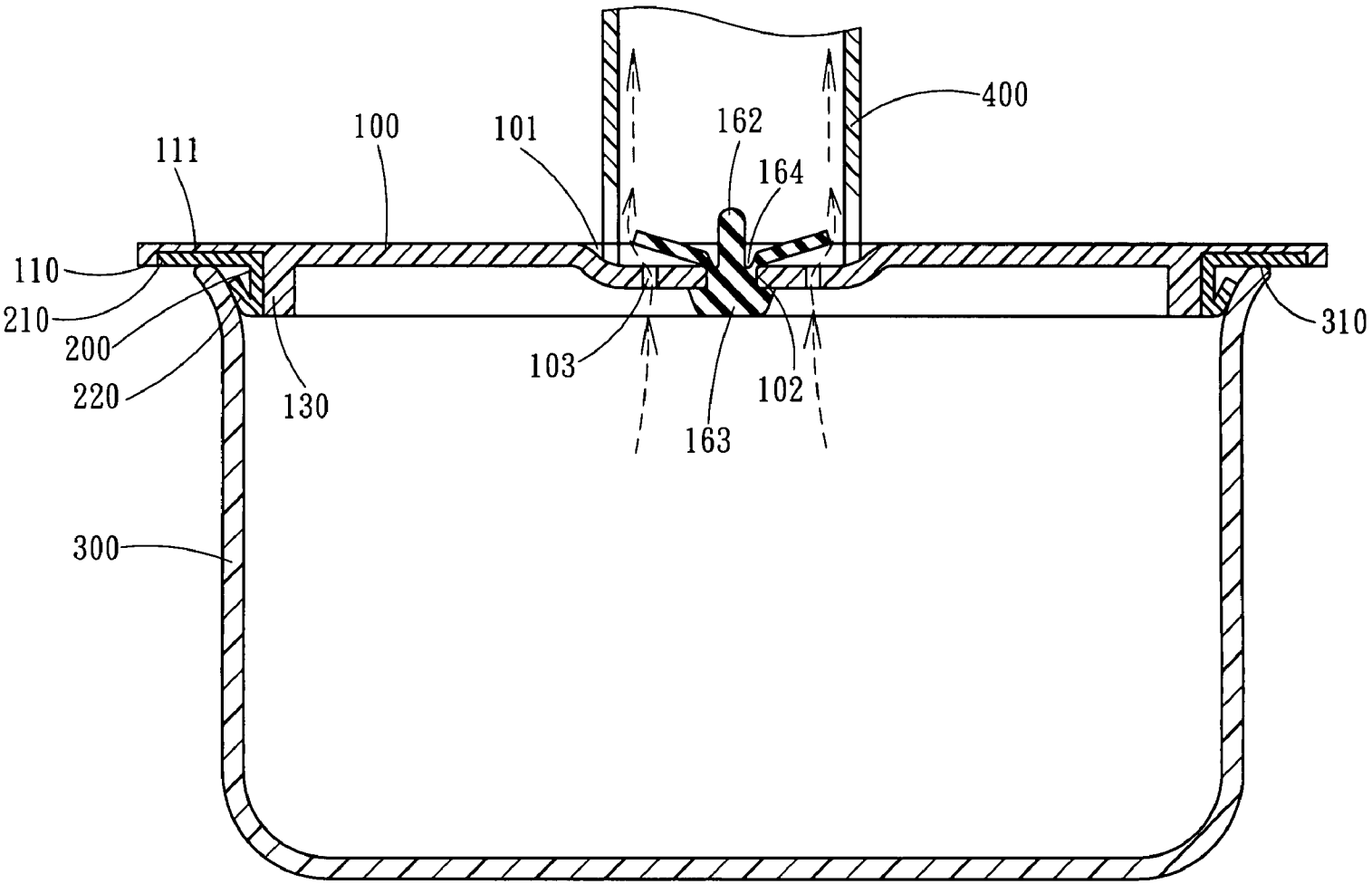
FIG. 8 is a sectional view of the sealing cover of the invention coupling with a container in a use condition for vacuuming.

Refer to FIG. 8, the cover 100 further has an indented recess 101 on an upper surface with the coupling opening 102 formed thereon. A hand-driven air suction means 400 can be mounted on the recess 101 to draw air. During vacuuming (such as drawing air through the hand-driven air suction means 400 on the recess 101) the flange blade 161 is lifted upwards due to airflow movement so that the air in the container 300 can be drawn out through the air vent 103. When the interior of the container 300 has reached a desired vacuum condition, and air drawing operation is no longer needed, the flange blade 161 on the air permeable parasol valve 160 rests closely on the upper side of air vent 103 under pressure to maintain the interior of the container 300 in a desired vacuum condition. Hence goods held in the container 300 can have a longer preservation time period. Moreover, as the second seal ring 220 squeezed and deformed between the annular jutting portion 130 and the inner wall of the container 300 could create air leakage in the vacuum condition, the first seal ring 210 is squeezed and compressed more tightly between the top coupling portion 110 and the top rim 310 of the container 300 in the vacuum condition, hence any gap that might exist between the annular jutting portion 130 and the inner wall of the container 300, and the thickness accuracy of second seal ring 220 do not have significant impact to the vacuum condition. As a result, air leakage problem through the second seal ring 220 can be prevented. The double layers sealing structure thus formed also can be fabricated easier.

Figure 9:
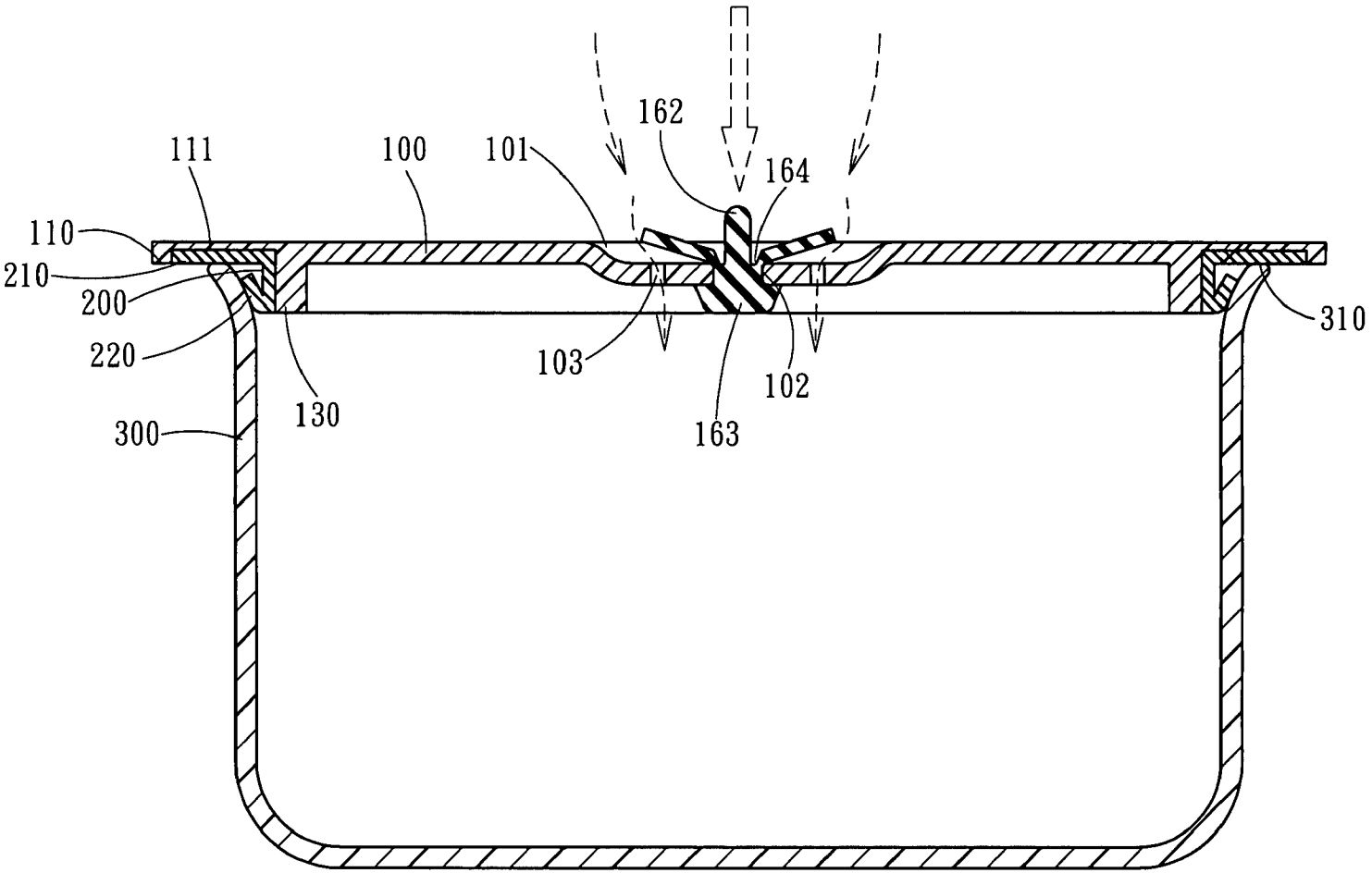
FIG. 9 is a sectional view of the sealing cover of the invention coupling with a container in a use condition for releasing pressure.

Refer to FIG. 9 for the invention in a condition to release the pressure. When there is a desire to open the cover 100, depress the depressing portion 162 of the air permeable parasol valve 160. The flange blade 161 is deformed under the downward pressure of the depressing portion 162 to be separated from the air vent 103 on the recess 101. Then external air can smoothly enter the container 300, and the cover 100 can be opened easily.

The sealed cover of the invention can be used on various sizes of containers. Air in a large container can be directly drawn out while smaller containers held in the large container can release the air to the large container to be drawn out through the large container. Thus the containers located inside and outside can be vacuumed as desired.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A sealing cover for a container, the sealing cover comprising:

an annular jutting portion which is located at a lower side of the sealing cover to be inserted in an opening of the container and surrounded by a top coupling portion;

a seal ring which surrounds the annular jutting portion and has two blades extended outwards to form a first seal ring fastened to the surface of the top coupling portion and a second seal ring close to a top end of the annular jutting portion;

a coupling opening formed on a surface of the sealing cover;

at least one air vent formed on the surface of the sealing cover and spaced apart from the coupling opening; and an air permeable parasol valve that is installed in the coupling opening including a flange blade to cover an upper side of the air vent, a depressing portion located above the flange blade, and a retaining portion located below the flange blade to be inserted and coupled with the coupling opening;

wherein when the depressing portion is depressed the flange blade warps upwards to separate from the air vent of the sealing cover to allow air inside and outside the container to circulate; and wherein the depressing portion and the flange blade join at a juncture which has an indented bending trough formed thereon.

2. The sealing cover of claim 1, wherein the annular jutting portion has an outer diameter slightly smaller than the opening of the container such that after the annular jutting portion is inserted in the opening the second seal ring is squeezed between the annular jutting portion and an inner wall of the container, and the first seal ring is squeezed between the top coupling portion and a top rim of the opening of the container.

3. The sealing cover of claim 1, wherein the top coupling portion surrounds the annular jutting portion and has a groove for wedging the first seal ring therein.

4. The sealing cover of claim 1, wherein the top coupling portion is extended to form a moving flange from a selected location.

5. The sealing cover of claim 1, wherein the sealing cover has an indented recess formed on a top surface thereof, the coupling opening being formed on the recess.

* * * * *